US007845462B2

(12) United States Patent
Moore

(10) Patent No.: US 7,845,462 B2
(45) Date of Patent: Dec. 7, 2010

(54) WIDE FREQUENCY RANGE HORN WITH MODULAR METHOD FOR REDUCING DIFFRACTION EFFECTS

(76) Inventor: Dana A. Moore, 25-175th Pl. SE., Bothell, WA (US) 98012

( * ) Notice: Subject to any disclaimer, the term of this patent is extended or adjusted under 35 U.S.C. 154(b) by 167 days.

(21) Appl. No.: 12/221,898

(22) Filed: Aug. 7, 2008

(65) Prior Publication Data

US 2010/0032233 A1 Feb. 11, 2010

(51) Int. Cl.

| | |
|---|---|
| ***G10K 11/02*** | (2006.01) |
| ***G10K 11/08*** | (2006.01) |
| ***H04R 1/20*** | (2006.01) |
| *G10K 11/00* | (2006.01) |
| *H04R 1/22* | (2006.01) |

(52) U.S. Cl. ..... 181/192; 181/191; 181/155; 381/340; 381/160; 381/387

(58) Field of Classification Search ..... 181/192, 181/191, 186, 189, 190, 155, 152, 159; 381/339, 381/340, 160, 153, 154, 156, 387
See application file for complete search history.

(56) References Cited

U.S. PATENT DOCUMENTS

| | | | | |
|---|---|---|---|---|
| 1,635,837 | A * | 7/1927 | Haag | 369/9 |
| 2,239,503 | A * | 4/1941 | Kreuser | 381/355 |
| 3,536,862 | A * | 10/1970 | Weingartner | 381/160 |
| 3,866,712 | A * | 2/1975 | Carruthers | 181/178 |
| 4,071,112 | A * | 1/1978 | Keele, Jr. | 181/187 |
| 4,091,891 | A * | 5/1978 | Hino et al. | 181/185 |
| 4,230,905 | A * | 10/1980 | Crum et al. | 381/300 |
| 4,289,929 | A * | 9/1981 | Hathaway | 381/351 |
| 4,344,504 | A * | 8/1982 | Howze | 181/187 |
| 4,369,857 | A * | 1/1983 | Frazer et al. | 181/159 |
| 4,701,951 | A * | 10/1987 | Kash | 381/304 |
| 5,078,074 | A * | 1/1992 | Gomez | 116/137 R |
| 6,860,363 | B2 * | 3/2005 | Gardner et al. | 181/155 |
| 7,178,629 | B2 * | 2/2007 | Vincenot | 181/191 |
| 7,299,893 | B2 * | 11/2007 | Meyer et al. | 181/188 |
| D586,330 | S * | 2/2009 | Moore | D14/214 |
| D598,427 | S * | 8/2009 | Moore | D14/214 |
| 2004/0216948 | A1 * | 11/2004 | Meyer et al. | 181/188 |
| 2006/0169530 | A1 * | 8/2006 | Noselli et al. | 181/187 |
| 2007/0056796 | A1 * | 3/2007 | Marlowe | 181/199 |

FOREIGN PATENT DOCUMENTS

| | | | |
|---|---|---|---|
| JP | 10066183 | A * | 3/1998 |

* cited by examiner

*Primary Examiner*—Edgardo San Martin

(57) ABSTRACT

A middle to high frequency straight pathway horn with wide horizontal dispersion characteristics having extended terminus side walls which approach a perpendicular angle compared to the horn axis which are further extended by a rearwardly divergent angled or curved surface from the terminus frontal plane to reduce the deleterious effects of horn mouth, edge, and baffle diffraction, allowing for traditional front baffle mounting or free-standing use. Modular baffle elements allow the invention to be configured for the further reduction of diffraction effects in a variety of applications.

20 Claims, 3 Drawing Sheets

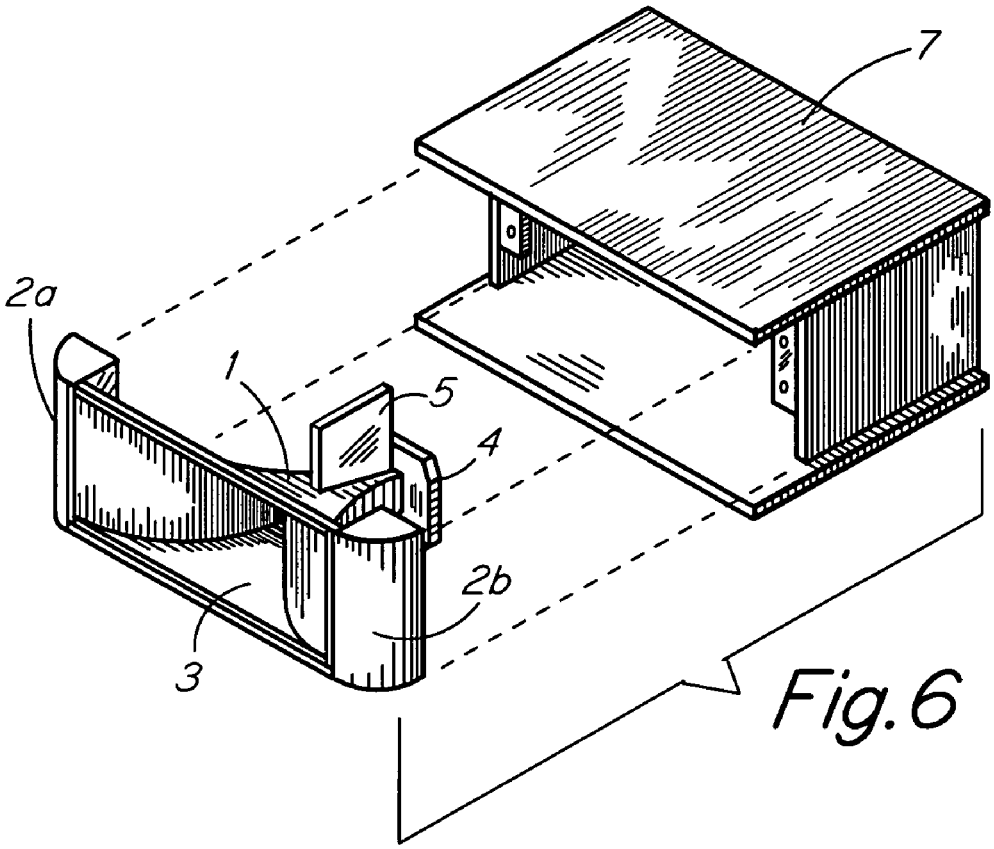
Fig. 6
Fig. 7
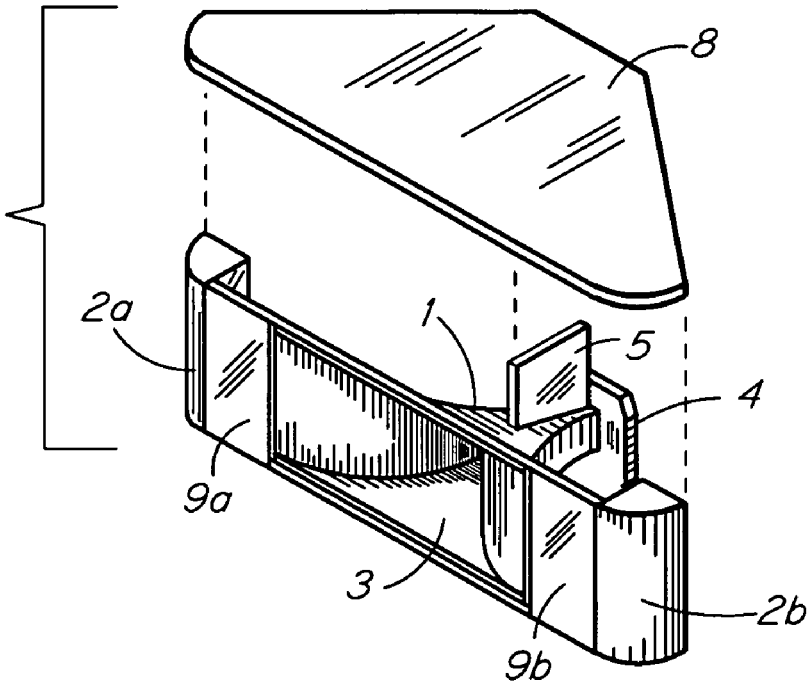

WIDE FREQUENCY RANGE HORN WITH MODULAR METHOD FOR REDUCING DIFFRACTION EFFECTS

BACKGROUND OF THE INVENTION

The present invention relates to high frequency loudspeaker horns. More specifically, it relates to midrange and high frequency horn termini, horn enclosure and baffle acoustic interactions, and reducing subsequent horn mouth and cabinet diffraction effects.

The current availability of coaxial or extended frequency range compression drivers promote the use of single horns for loudspeakers whereas in the past two or more separate horns were typically required. A horn using the tractrix expansion formula has proven to be particularly adept at propagating an extended frequency response and presenting a wider coverage pattern in a relatively compact size, as compared to an exponential horn of the same overall low frequency cutoff (Fc). The use of a single horn for upper frequency reproduction is preferable to using multiple frequency-divided horns as it presents a single point acoustic source to the audience.

An important consideration in selecting an appropriate horn mouth size and shape in such an application as described above is that horns of this type are typically mounted or placed on top of (or in close proximity) a bass cabinet, which is usually wider than the high frequency horn mouth. Being close to a sharp-edged planar element such as embodied by a bass cabinet and/or any other edged boundary will propagate aberrant diffraction events. This presents the problems associated with baffle diffraction (the baffle being the front-facing mounting panel to which the high frequency horn is typically mounted) and any resultant cabinet diffraction around the mounting baffle and associated enclosure, if any. Since the high frequency horn or cabinet housing associated with the high frequency horn is usually on top of the bass enclosure, the diffraction experienced is usually more acute to each side of the mounting baffle or horn mouth.

It is well known in the art that transitions in the shape of a loudspeaker enclosure such as edges or slots act as additional acoustic sources. Sound wave arrivals from these acoustic sources are typically delayed behind the primary wave and are usually reversed in polarity. Additionally, it is also well known in the art that directivity is not governed exclusively by mouth or horn shape, but that diffraction from the mouth and from intermediate transitions can also influence the qualities of both response and directivity as much as the interior horn shape. Naturally, these aberrant elements should be avoided whenever possible.

A loudspeaker enclosure shape which specifically reduces horizontal cabinet diffraction was disclosed in the text book "Acoustical Engineering", by Harry F. Olson (D. Van Nostrand, Princeton, N.J., 1957) page 169 figure 6.45, which employs receding vertical baffle angles on each front corner of a planar front baffle in which the sound producing source was centrally located. The similarities between the cited prior art and a high frequency horn placed on top of a large bass enclosure can be seen to form a typical loudspeaker shape, that is, a generally rectangular parallelepiped form which is subject to horizontal cabinet diffraction effects in combination with the possible addition of horn mouth diffraction.

The properly designed tractrix horn mouth with expanded horizontal dispersion characteristics tends to terminate with its horn walls substantially perpendicular to the horn pathway axis. Theoretically, the waveform propagation of such a device is hemispherical rather than planar. The perpendicular horn terminus side walls tend to reduce diffraction in that there is no abrupt corner for the waveform to act as an additional sound source. When such a horn is mounted to a flat baffle, a typical application, as when mounted inside an enclosure to be placed on top of a low frequency cabinet, the top enclosure sides will typically have sharp corner edges and will tend to introduce aberrant waveform propagation behavior. The production of a high frequency horn enclosure without acoustically sharp edges may also introduce economic concerns and most manufacturers accept the deleterious effects of diffraction associated with the more economically constructed forms.

Middle range frequency horns are typically produced with an integral flat flange-type mounting frame adjacent to the horn mouth for attaching the horn to a flat baffle. In addition to adding surface area requirements when attaching such a horn to a cabinet or baffle as is common to the art, horn mouth terminus-based horn mounting flanges tend to act as baffle surface interruptions, which may not be considered critical for midrange frequency reproduction, but may adversely effect high frequencies due to the very short wavelengths involved.

The formulas for calculating the values of tractrix horns are well known in the art. Such examples can be found in the magazine article "The Tractrix Horn Contour", by Bruce C. Edgar, Speaker Builder magazine, February 1981, and a practical how-to tractrix horn design is presented in another article by the same author titled "The Edgar Midrange Horn", Speaker Builder magazine, January 1986. The tractrix expansion rate is preferred in the current invention due to its substantially 90 degree side wall terminus plane compared to the pathway axis, however, the current invention is not limited to its exclusive use, and other expansion rates may be used as desired. In addition to the previously mentioned attributes of the tractrix horn capable of the of the frequency range presented above having a relatively compact size and wide bandwidth capability, the propagation characteristics of the tractrix flare are conducive to being readily enhanced by the current invention.

Essentially the same diffraction-producing conditions exist with the application of a high frequency horn being centrally mounted on a front baffle (as is typical of most applications which employ a midrange horn), and by logical extension, the benefits of reduced horizontal cabinet diffraction can be achieved by applying the same solution as shown in the Olson prior art device mentioned previously. However, in the case of a free-standing upper frequency horn, that is, an application where no top enclosure is desired or present for reasons of cost or aesthetic considerations, a cabinet-based diffraction reducing solution such as in the cited prior art is not possible.

It is therefore desirable to produce a wide bandwidth (midrange and high frequency) horn which does not require a traditional baffle mount and which preferably comprises its own baffle while reducing the deleterious effects of horizontal horn mouth and/or cabinet diffraction to practical or negligible limits, while providing a variety of mounting options and enclosure methodologies to be easily and economically realized.

SUMMARY OF THE INVENTION

It is an object of the present invention to provide a reduction in horn mouth diffraction particularly horizontal diffraction when compared to flat baffle mounted horns of the same Fc and overall mouth size.

An additional object of the invention is to provide increased versatility in mounting applications, specifically, the ability to perform with or without a front baffle mounting, as in a free-standing application while reducing diffraction effects.

A further object of the invention is to provide the ability to adapt the invention to maximize the diffraction reducing capabilities of the invention in a given application by the use of optional modular elements in close proximity to the horn mouth.

The current invention is capable of being operated in a free-standing manner or optionally mounted in a cabinet or enclosure, as it includes within itself an integral diffraction reducing horizontal baffle. The current invention maximizes the ability to produce acoustic benefits of reduced horn mouth and/or cabinet diffraction regardless of the cabinet or enclosure it is mounted in or is placed on top of due to its modular nature.

The current invention is fully scalable as needed. Various mounting techniques may be easily applied through the use of modular parts, allowing the invention to be used in a variety of applications, and is highly adaptable to cosmetic and economic goals.

The current invention can be manufactured in various materials and methodologies.

DESCRIPTION OF THE DRAWINGS

FIG. 6 is a perspective exploded view of the preferred embodiment and optional enclosure assembly.

FIG. 7 is a perspective view of an alternative embodiment employing a simple cover panel.

DESCRIPTION OF THE INVENTION

Figure 1:
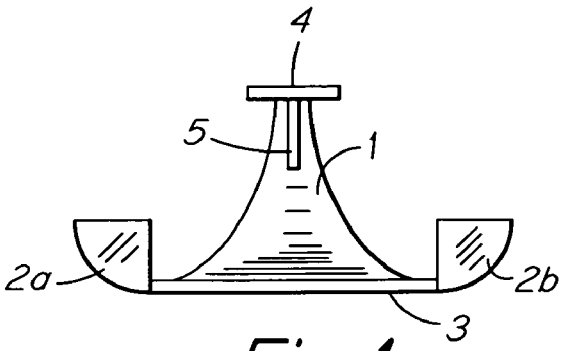
FIG. 1 is a top elevation view of the preferred embodiment of the invention.

The present invention is comprised of a single midrange horn with a terminal expansion rate which terminates with the horn side walls being substantially perpendicular to the pathway axis with integral outer side elements which form a mountable structure for the invention and an attachment substrate for the further optional mounting of modular parts specifically to reduce diffraction effects commonly associated with horn mouths and flat baffles. The tractrix expansion rate is preferred due to its quality of high fidelity reproduction, relatively compact size for a given Fc, propagation characteristics, the side wall termination angles that the expansion formula typically produces, and ability to propagate high frequencies with a minimum of high frequency "beaming" effects from a coaxial or an extended range compression driver which eliminates the need for a separate high frequency horn and driver. It should be noted that while the use of the tractrix terminal expansion curve is preferred for the horn component of the invention, virtually any horn expansion formula or mix of formulas can be used as long as the terminal side wall angles tend to end in a substantially perpendicular angle to the pathway axis. The nature of such a side wall termination angle is that a relatively smooth surface transition can be made from horn mouth sides to a diffraction reducing component or optional baffle extensions as desired. The current invention is intended to be used in conjunction with a low frequency unit, and the low frequency cutoff of the horn component of the invention shown in the drawings is approximately 400 Hz, and the high frequency limit of the device is determined by the capabilities of the driver employed. The benefits provided by a single wide frequency range horn are economical as well as acoustical, and the current invention provides further benefits of increasing application versatility and a reduction of the deleterious effects of horn mouth and cabinet (or baffle) diffraction in all applications.

Referring to FIG. 1, the present invention preferred embodiment is disclosed as seen from the top, where the concept of continuing the curve derived from the terminal sidewalls of the tractrix horn can be seen to be extended around the side edges as defined by outside corner elements 2*a*, 2*b* of the invention. A defining characteristic of the invention in its preferred embodiment is that no mounting frame or flange common to the art is present. The tractrix horn body 1 encloses an expanding column of air which proceeds from the throat opening 4, best seen in FIG. 3 to the horn terminus (or mouth) 3. An actual match of the horn terminal side wall exit angle is not required to reduce diffraction. While the horizontal distance between the actual horn terminus 3 and the curved outer side corner elements 2*a*, 2*b* is minimal in the drawings seen in FIGS. 1 through 6, a distance of a flat section could be included as the application requires without detriment to the performance of the invention. This is shown in FIG. 7, where the flat baffle extensions 9*a*, 9*b* are shown. The disclosed drawings represent the invention being constructed from wood although other materials and methodologies could be used, such as resin or plastic casting and the like. The corner elements 2 are shown in the drawings (except FIG. 2) as being constructed as a solid structural element, such as solid wood, however, it will be realized that the same essential outside curve or surface can be obtained with other construction techniques and/or materials.

Figure 2:
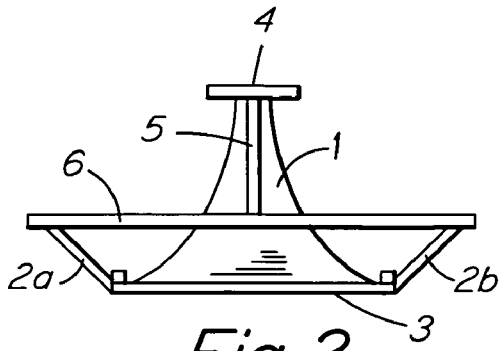
FIG. 2 is a top view of an alternative embodiment of the invention.

FIG. 2 shows an alternative embodiment as viewed from the top which uses a planar approach which utilizes 45 degree angles to approximate a curve in parts 2*a*, 2*b* of FIG. 2. Various degrees of multiple angled pieces may also be used to accomplish the same function, and could possibly be regarded as an attractive decorative quality. Where the planar approach disclosed in FIG. 2 is more economical to construct, it lacks the aesthetic quality presented by a smooth curve. Whether employing a planar surface as seen in FIG. 2, or a gradually receding surface as seen in FIGS. 1, 3, 4 and 5, as embodied in the side corner elements 2*a*, 2*b* is not considered critical to the function of the device as long as a divergently receding and/or graduated surface from the frontal plane is present. There is no particular need for further side wall extensions as seen in FIG. 7 as baffle extension parts 9*a*, 9*b*, to be present other than that disclosed in the drawings, except for specifically obtaining a desired width typically for cosmetic reasons. The alternative embodiment in FIG. 2 also discloses a flat baffle mounting frame 6, allowing the invention to be easily attached to a larger flat baffle in the traditional manner and exhausting through a baffle cut out as is common in the art. It should be noted in such a case that the horn terminus 3 would extend beyond the front baffle, and that optional covering top and or bottom elements could be added to the protruding horn structure to fully enclose the invention as desired.

Figure 3:
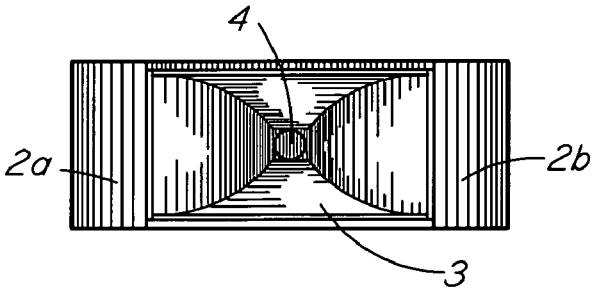
FIG. 3 is a front elevation view of the preferred embodiment.
Figure 4:
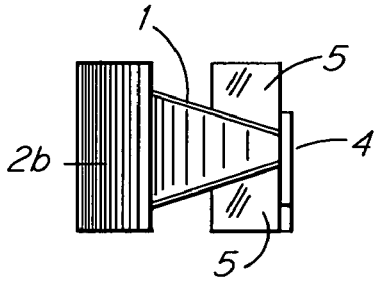
FIG. 4 is a side elevation view of the preferred embodiment.
Figure 5:
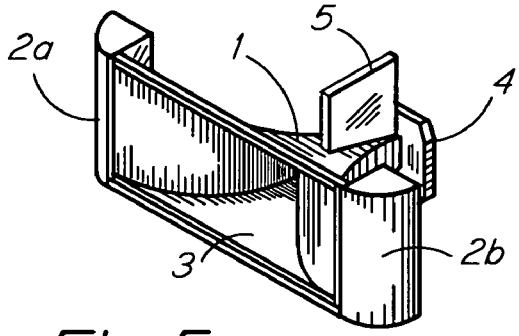
FIG. 5 is a perspective view of the preferred embodiment.

FIG. 3 discloses a side view of the preferred embodiment, and FIG. 4 represents a perspective view of the preferred embodiment. Due to the nature of the current invention and its use being most likely that of being placed on top of a low frequency cabinet of some sort, the vertical dispersion pattern of the invention is not considered as critical as the horizontal dispersion. It should be noted, however, that the same diffraction-reducing technique shown on the sides of the horn terminus 3 as embodied in corner elements 2 can be applied to the upper and lower horizontal edges of the invention if the intended use is such that no close boundary conditions are present, such as when being the invention is suspended in some manner.

The present invention allows for free-standing use which does not include a baffle mounting frame 6 as seen in FIG. 2, or a conventional mounting flange as is common to the art, and therefore may or may not be finished in a decorative manner. In such a case, it may be desirable to include a top panel cover 8 for decorative purposes such as that seen in FIG. 7. In the case where the current invention is to be placed on a wide cabinet, the distance(s) between the horn terminus sides and the corner elements 2 curved edges may be increased to comparable width for appearance considerations. The current invention may optionally employ a mounting flange 6 as determined by the application.

FIGS. 1, 2, 4, and 5 disclose optional stand-like vertical supports 5 attached to the horn structure which are dependent on the particular use and may or may not be needed in some applications. The preferred embodiment does not include a front-mounting flange or frame structure 6 as do most prior art horns which are intended to be mounted to flat baffles. The addition of a vertical stand support 5 allows for free-standing use and reduces the requirements of attachment strength needed for enclosed applications. The optional vertical supports 5 also tend to reduce horn wall vibration.

As seen in FIG. 6, the current invention may be used as an effective front panel for a cabinet enclosure 7 and also provides the front corner elements 2 of such a cabinet, allowing for insertion of the horn unit from the front of the enclosure, providing a high degree of versatility in presenting possible applications. FIG. 6 describes an alternative horn enclosure 7 assembly in which the preferred embodiment as an integral unit is inserted and attached from behind (or inside the cabinet), with no screws showing from the front.

FIG. 7 shows an alternative embodiment which uses flat front baffle extensions 9*a*, 9*b* to allow for matching the width of a wide bass cabinet with which the alternative embodiment is associated. Additionally, the alternative embodiment shown in FIG. 7 includes a top panel 8 which acts as a partial enclosure for the horn structure, which can be regarded as an intermediate step both economically and aesthetically between a fully enclosed horn and simple free-standing placement. The use of a cover panel 8 as shown in FIG. 7 is entirely optional; however, it can be seen to add versatility to the use and appearance of the invention.

Figure 8:
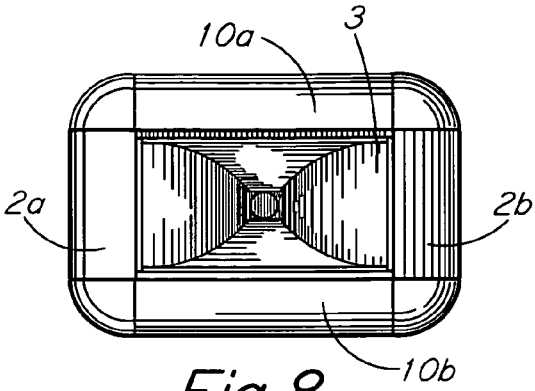
FIG. 8 is a front view of an alternative embodiment.
Figure 9:
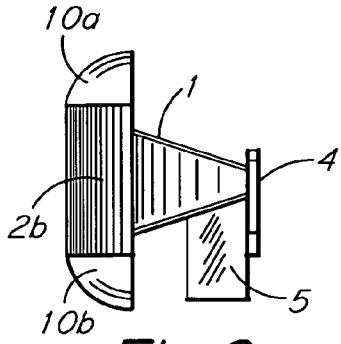
FIG. 9 is a side view of the alternative embodiment.
Figure 10:
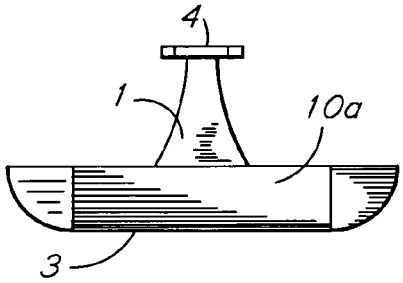
FIG. 10 is a top view of the alternative embodiment.
Figure 11:
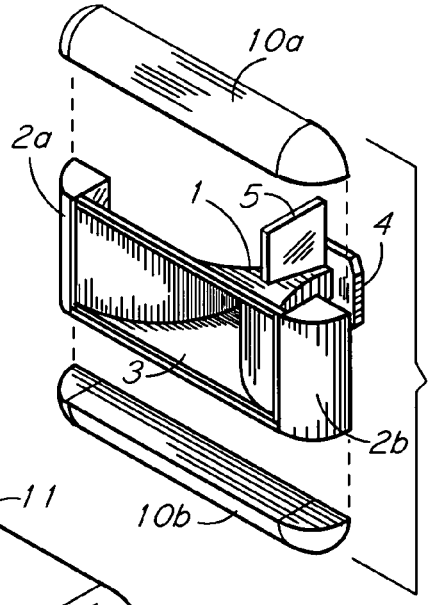
FIG. 11 is an exploded perspective view of the alternative embodiment.

FIG. 8 discloses another alternative embodiment which uses matching curved elements 10*a*, 10*b* on the top and bottom, respectively, of the invention to further reduce vertical horn mouth and any cabinet diffraction that might occur. FIGS. 8 through 11 show the same alternative embodiment in front, side, top and exploded perspective views, respectively.

Figure 12:
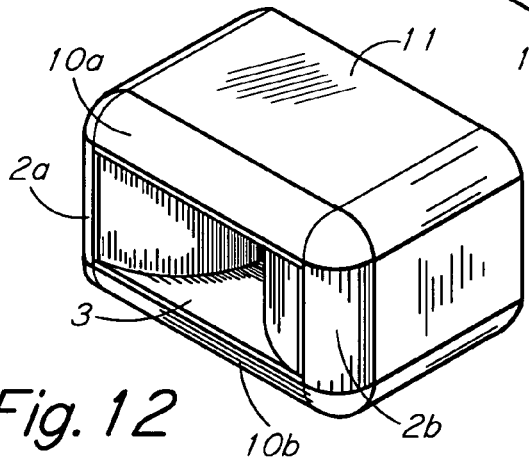
FIG. 12 is a perspective view of the alternative embodiment installed in an optional enclosure assembly.

The embodiment disclosed in FIGS. 8 through 11 uses top 10*a* and bottom 10*b* elements with a related curve embodied in the side corner elements 2. This is more of an aesthetic concern rather than an acoustic one in that the vertical diffraction events are less detrimental to the dispersion characteristics of the invention when placed on top of a bass cabinet. For optional use such as when suspended or otherwise separated from a suitable mounting platform, vertical diffraction effects may be reduced by the cabinet assembly 11 shown in FIG. 12. An alternative configuration not shown in the drawings would be one of the preferred embodiment with only a top curved element such as part 10*a* shown in FIG. 11, and with no lower curved element attached, implying operational placement on top of a lower cabinet as discussed previously where the proximity of the lower cabinet would tend to reduce downward diffraction events. Additionally, a fully-enclosed cabinet such as that seen in FIG. 12 would seem preferable in an environment where particulates in the air might be present. It may be desirable to have a rearward angle applied to the cabinet assembly 11 allowing more of a teardrop shape rather than having parallel sides and/or top and bottom panels as shown in FIG. 12, especially for a suspended application. An application which includes an enclosure such as that shown in FIG. 12 would imply but not require that the modular parts such as the top and bottom elements 10 be permanently attached or the invention otherwise be a single integrated unit.

The current invention is suitable for free-standing use, both utilitarian and in environments where aesthetics concerns are important by the use of various modular mix-and-match elements, combined with optional enclosure assemblies in which the current invention is highly versatile as a structural and aesthetic component, as well as providing acoustic performance with reduced diffraction effects.

Wherein this disclosure depicts one specific type of manufacture, such as wood multiple-ply panels, it should not be limited to materials and processes that utilize only straight planar elements, such as plywood and the like. The current invention is capable of being manufactured by other methods and materials such as resin-type or plastic casting and the like.

While in accordance with the provisions of the Patent Statutes, the preferred forms and embodiments have been illustrated and described, it will become apparent to those skilled in the art that various changes and modifications may be made without deviating from the inventive concepts set forth above.

I claim:

1. In a loudspeaker horn for operation in a middle to high frequency range, an axially straight pathway horn body having a throat arranged rearwardly and employing a terminal expansion rate resulting in the horizontal side horn walls terminating in a front plane substantially perpendicular to the horn pathway axis, and partially forming a mouth therewith, said horn mouth being proportioned primarily for horizontal dispersion, and further comprising a modular horn mouth rearward extension, said extension consisting of at least two outer side baffles engaged in sealed relation with at least two opposite and outer sides of said mouth and adapted to be substantially equal in at least one dimension relative to the corresponding terminal dimension of said horn mouth sides, and reciprocally arranged to splay rearwardly on at least two opposite sides of said horn mouth, said side baffles each comprising an angled surface that progresses without acoustically significant interruption from said front plane of said horn mouth and terminating rearwardly in a parallel spaced plane from said front plane, wherein said angled surfaces are further each adapted to form a smooth and continuous outwardly disposed facing which progresses from the frontal plane of the horn terminus by which sound waves propagating from said mouth traveling perpendicular to said axial pathway are substantially prevented from the effects of diffractive disbursement generally associated with acoustically significant interruptive edges, said edges thereof being thereby disposed rearwardly of said horn mouth, and each said outer side baffle further providing a rearward and upper and lower attachment surface, means for completing said horn body and said horn mouth, and means for fixing the position and attitude of said horn body axial pathway in relation to a horizontal surface.

2. In a loudspeaker horn as set forth in claim 1, wherein said angled surfaces consist of curved elements.

3. In a loudspeaker horn as set forth in claim 1, wherein said angled surfaces consist of a series of planar elements arranged to approximate a curve.

4. In a loudspeaker horn as set forth in claim 1, wherein said angled surfaces consist of straight planar elements.

5. In a loudspeaker horn as set forth in claim 1, wherein said horn body completing means includes top and bottom planar elements arranged in sealed engagement with said side horn walls, completing said horn body and said horn mouth.

6. In a horn type loudspeaker as set forth in claim 1, wherein said horn body completing means includes a rearwardly located apertured panel mounted perpendicular to said axial pathway and adapted for the sealed engagement of a horn driver to propagate sound waves from said driver though said aperture to said throat.

7. In a horn type loudspeaker as set forth in claim 1, wherein said positional fixing means includes a vertically oriented mounting frame assembly disposed rearwardly of said outer side baffles and engaged in sealed relation therewith, and with said attachment surfaces for attaching said horn body to a flat baffle.

8. In a horn type loudspeaker as set forth in claim 1, wherein said positional fixing means includes at least one vertically arranged and axially aligned weight-bearing stand component attached to the underside of said horn body with one end thereof proximate to said throat thereby substantially supporting the throat end of said horn body in combination with said horn mouth to allow for free-standing use.

9. A loudspeaker horn for middle to high frequency sound propagation, comprising:

a plurality of baffles in relation to form an air-tight expanding conduit arranged for wider horizontal dispersion than vertical dispersion, with said conduit interior surfaces defining an air column with the smaller end of said air column being disposed rearwardly, a single aperture in one of said baffles, said baffle being arranged rearwardly at the smaller end of said expanding air column, with said aperture being adapted to be closed by at least one driving unit, and arranged to propagate sound waves frontally though said aperture, said air column expanding at a suitable low frequency cutoff rate from said aperture and terminating said air column in a frontally disposed perpendicular plane from the axis of said air column, said aperture, and said driving unit, forming a mouth thereby, with the outer horizontal side walls of said mouth terminating at and substantially parallel to said frontally disposed perpendicular plane, and further at least two baffles arranged vertically in an axially mirrored fashion to each form a rearward angle proceeding from the said frontal plane on at least two opposite sides of said mouth, said at least two baffles each adapted in at least one dimension to correspond proportionally with each said opposite side of said mouth and engaged in sealed relation therewith, said at least two baffles further adapted to be duplicates of each other thereby defining a matched pair, said matched pair further defining an integrally formed reciprocally-disposed oblique facing on each respective side of said mouth which terminates in oppositely arranged horizontally spaced planes, each said spaced plane being parallel to the axis of said air column and said aperture, comprising a diffraction reducing horn mouth extension, said extension further including attachment surfaces.

10. A loudspeaker horn as set forth in claim 9, wherein said oblique facing is achieved by a continuous curve between said mouth plane to said side plane.

11. A loudspeaker horn as set forth in claim 9, wherein said oblique facing is achieved by a planar element between said mouth plane to said side plane.

12. A loudspeaker horn as set forth in claim 9, wherein said oblique facing is achieved by a series of planar elements arranged to form a continuous outer surface formed of facets.

13. A loudspeaker horn as set forth in claim 9, wherein said oblique facing is arranged to provide an uninterrupted surface.

14. A loudspeaker horn as set forth in claim 9, wherein said horn mouth extension is further extended horizontally in planar fashion with intermediate panels arranged between said mouth and said rearward angled baffles providing an increase in overall planar width.

15. An improved horn loudspeaker body for the propagation of middle to high frequency sound waves, wherein the improvement comprises:

a horn mouth extension comprising at least one pair of oppositely disposed and rearwardly diverging angled elements engaged in sealed relation with at least two opposite sides of the outer edges of the horn mouth terminus, said angled elements each being further adapted to correspond proportionally to each respective outer edge of said horn mouth and arranged to progress substantially rearward from the mouth frontal plane forming a substantially edge-less surface tangentially receding from said at least two sides of the outer edges of said horn mouth, thereby forming a substantially beveled corner on each outer side thereof, and each said corner further including attachment surfaces.

16. An improved horn loudspeaker body as set forth in claim 15, wherein said angled elements each includes a curved outer surface.

17. An improved horn loudspeaker body as set forth in claim 15, wherein said angled elements each includes a planar outer surface.

18. A loudspeaker horn assembly comprising:

a horn structure for the propagation of middle to high frequencies including at least two flaring sides terminating in a substantially perpendicular plane compared to the axial pathway, with said terminating plane being frontally arranged, and further including at least two outwardly disposed side elements each oppositely arranged to form an axially divergent receding surface progressing rearwardly from the proximate outer oppositely disposed edge of each said at least two terminating flaring sides at said frontal plane towards equally spaced parallel side planes, said side planes arranged substantially parallel to said horn axial pathway and rearward of said terminating plane, said side elements further adapted in at least one proportion to substantially match the proximate dimensions of said terminating flaring sides, said side elements further being engaged in sealed relation with the opposite and outwardly disposed terminating edges of said at least two terminating flaring sides and thereby forming a substantially uninterrupted surface progressing from said flaring sides to the rearmost external boundaries of said at least two side elements.

19. A loudspeaker horn assembly as set forth in claim 18, wherein said side elements include a rearward terminus which forms a parallel spaced plane from said frontal terminating plane for use as a mounting surface.

20. A loudspeaker horn assembly as set forth in claim 18, wherein said side elements include a rearwardly arranged metal bracket forming a parallel spaced plane from said frontal terminating plane for use as a mounting surface.

* * * * *